US005623910A

United States Patent [19]

Riggle

[11] Patent Number: 5,623,910

[45] Date of Patent: Apr. 29, 1997

[54] CHECK AND VENT VALVE ASSEMBLY

[75] Inventor: Russell K. Riggle, Newcomerstown, Ohio

[73] Assignee: Walbro Corporation, Cass City, Mich.

[21] Appl. No.: 347,283

[22] Filed: Nov. 30, 1994

[51] Int. Cl.[6] ..... F02M 37/04

[52] U.S. Cl. ..... 123/510; 123/497; 123/459

[58] Field of Search ..... 123/497, 510, 123/459, 506, 511

[56] References Cited

U.S. PATENT DOCUMENTS

| | | | |
|---|---|---|---|
| 5,044,344 | 9/1991 | Tuckey | 123/497 |
| 5,148,792 | 9/1992 | Tuckey | 123/497 |
| 5,195,494 | 3/1993 | Tuckey | 123/510 |
| 5,289,810 | 3/1994 | Bauer et al. | 123/510 |
| 5,295,469 | 3/1994 | Kariya et al. | 123/467 |
| 5,339,785 | 8/1994 | Wilksch | 123/497 |
| 5,361,742 | 11/1994 | Briggs et al. | 123/497 |
| 5,365,906 | 11/1994 | Deweerdt | 123/510 |

*Primary Examiner*—Thomas N. Moulis

*Attorney, Agent, or Firm*—Barnes, Kisselle, Raisch, Choate, Whittemore & Hulbert

[57] ABSTRACT

A combination check and vent valve assembly for an automotive engine fuel system. The valve assembly has a fuel passage through a housing with an inlet communicating with a fuel pump outlet and an outlet to supply fuel to the engine. A check valve is disposed within the fuel passage which is normally closed when the fuel pump is not operating, and will open when the inlet fuel pressure exceeds the outlet fuel pressure. A normally closed vent valve is disposed within the fuel passage upstream of the check valve and serves as a moveable seat for the check valve, which will open when the valve assembly outlet fuel pressure is greater by a predetermined value than the fuel pump outlet pressure to bleed fuel through the passage and to the pump to reduce the outlet fuel pressure to a predetermined minimum pressure.

20 Claims, 3 Drawing Sheets

CHECK AND VENT VALVE ASSEMBLY

FIELD OF THE INVENTION

This invention relates to automotive engine fuel systems and more particularly to a valve assembly for no-return fuel systems.

BACKGROUND OF THE INVENTION

A typical fuel system as disclosed in U.S. Pat. No. 5,044,344 for an internal combustion engine of an automobile has a fuel pump module in a fuel tank connected by a fuel delivery line to the fuel rail and injectors of the engine. Fuel systems of this type do not have any fuel return line from the rail or injectors to the fuel tank and hence are often referred to as a no-return fuel system.

In a no-return as well as in other types of fuel systems, it is desirable to reduce the number of fuel passages, which thereby reduces the number of possible failure modes or leak paths. It is also desirable to reduce the number of parts in a fuel system to simplify the assembly process, to reduce cost and to reduce the size and weight of components.

In some engines, it is desirable to vary the fuel pressure at the injectors under different operating conditions. In this type of engine, the fuel injectors require a substantially higher fuel pressure at full throttle than at idle. When such an engine rapidly goes from full throttle to idle, the injector fuel pressure should be reduced immediately to avoid an overly rich fuel-to-air mixture which would result in poor engine performance and excessive engine exhaust emissions. In "hot soak" conditions, it is common for the fuel pressure to be substantially greater than that required under normal operating conditions.

SUMMARY OF THE INVENTION

An improved fuel system of this invention is operable to reduce fuel pressure at the injectors when desirable, and includes a dual valve assembly in the fuel supply downstream of the fuel pump with a spring-biased check valve operable by a low pressure differential preventing reverse flow of fuel supplied to the engine. A vent valve is disposed in the same fuel passage with the check valve and serves as a movable seat for the check valve. The vent valve is spring biased in opposition to the check valve and is operable by a higher back pressure differential to bleed fuel back to the outlet side of the fuel pump through the same fuel passage to thereby reduce the pressure of fuel at the injectors. This keeps the fuel line fully charged with fuel from the fuel pump to the injectors, and avoids parasitic loss of fuel and system inefficiencies when the engine and fuel system are operating under load conditions. This also prevents an over pressure condition at the injectors when the engine load varies from full throttle to an idle or low load condition and/or in hot soak conditions.

Objects, features and advantages of this invention are to provide a fuel delivery dual valve assembly for a no-return fuel system which requires only one fuel passage, reduces the number of components, desirably reduces the pressure of fuel supplied to the injectors in response to certain engine operating conditions, reduces parasitic loss of fuel b keeping the fuel line and fuel pump fully charged, and is rugged, durable, maintenance free, light weight, of relatively simple and compact design, economical to manufacture and assemble, and has a long in-service useful life.

BRIEF DESCRIPTION OF THE DRAWINGS

These and other objects, features and advantages of this invention will be apparent in view of the following detailed description of the best mode, appended claims and accompanying drawings (which are to scale unless otherwise noted) in which:

DETAILED DESCRIPTION OF THE PREFERRED EMBODIMENT

Figure 1:
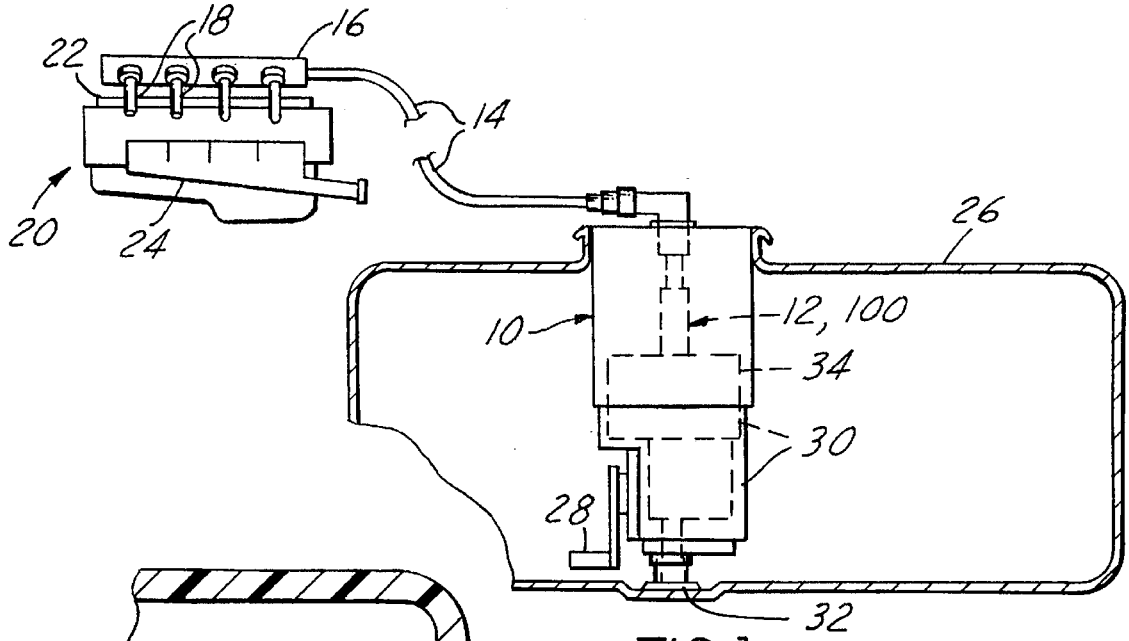
FIG. 1 is a fragmentary schematic view illustrating a fuel pump module with a valve assembly therein embodying this invention received in a fuel tank and connected to a fuel rail and injectors of an internal combustion engine for an automotive vehicle.

Referring in more detail to the drawings, FIG. 1 illustrates an integrated fuel pump module 10 with a dual valve assembly 12 embodying this invention connected by a fuel line 14 to a fuel rail 16 and associated fuel injectors 18 of an internal combustion engine 20 for an automotive vehicle and also provided with an air intake manifold 22 and an exhaust manifold 24. In assembly, pump module 10 is mounted in a fuel tank 26 and has a fuel level sensor 28 and a fuel pump 30 with an outlet connected to valve assembly 12 and an inlet communicating with the bottom of the tank through a fuel filter 32. The pump is driven b an electric motor 34, the speed of which may be varied to control the pressure of fuel delivered by the pump to the engine. The fuel system has no fuel return line from the engine to the fuel tank and hence is of the type often referred to as a "no-return" or "returnless" fuel system.

Figure 2:
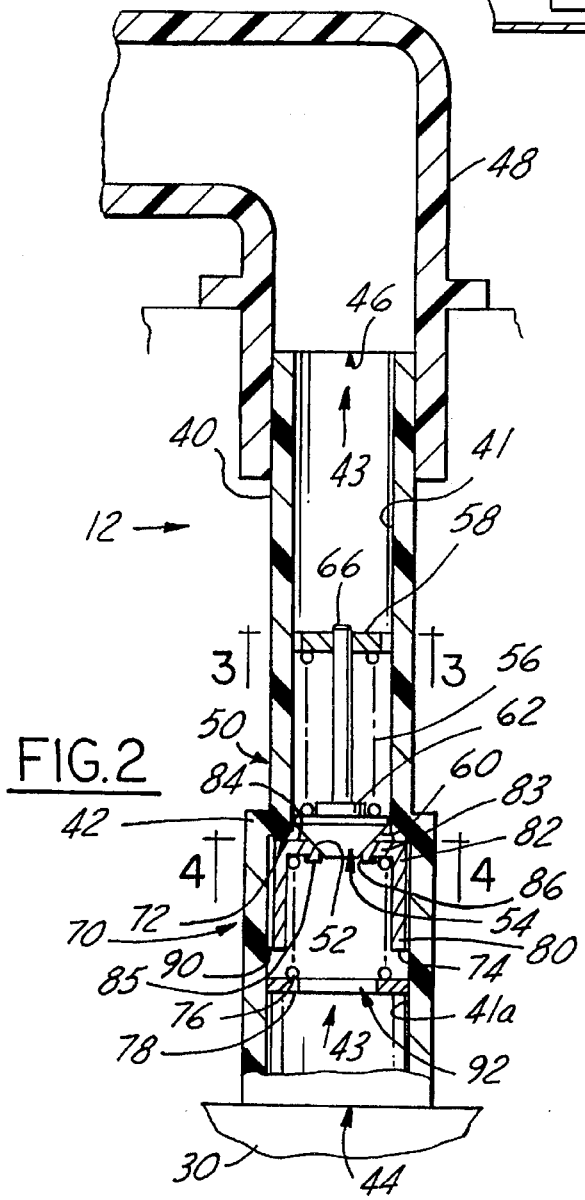
FIG. 2 is an enlarged fragmentary full sectional view of the valve assembly of FIG. 1 shown with the check valve and the vent valve in their closed positions.
Figure 3:
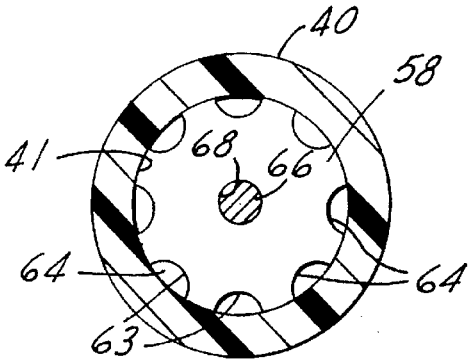
FIG. 3 is a cross-sectional view taken along line 3—3 of FIG. 2.
Figure 4:
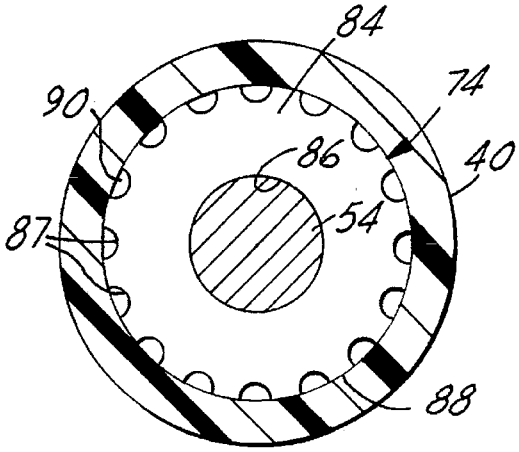
FIG. 4 is a cross-sectional view taken along line 4—4 of FIG. 2.

As shown in FIG. 2, valve assembly 12 has a housing 40 preferably molded of a synthetic resin. Housing 40 is of a generally cylindrical, dual diameter stepped shape having a bore 41 meeting a counterbore 41*a* at a shoulder 42. A fuel supply passage 43 extends axially through the entire length of the housing. An inlet 44 of the housing is connected in assembly to the outlet of fuel pump 30. The housing also has an outlet 46 communicating with inlet 44 through fuel passage 43 and an outlet connector 48 which in assembly is connected to fuel line 14. When the engine and fuel pump are shut down, the pressure of the fuel at outlet 46 of fuel passage 43 and in fuel line 14 is maintained by a normally closed check valve assembly 50 included within valve assembly 12 and which normally opens when the fuel pump is energized and allows fuel to flow through the fuel passage to the outlet.

Check valve assembly 50 is yieldably biased closed against a movable valve seat 52, and comprises a poppet valve body 54 slidably received with a loose clearance in bore 41. Valve body 54 is yieldably biased to its closed position by a compression coil spring 56 retained at its upper end by a star washer 58 press fit into the cylindrical bore 41 of housing 40 upstream of the outlet 46 of fuel passage 43. Valve body 54 has a frusto conical surface 60 tapering towards inlet 44 of valve assembly 12. Valve seat 52 is tapered to the same degree as surface 60 to provide the mating seating surface. The lower end of spring 56 rests against valve body 54 and is radially retained by a shoulder 62 on the valve body. When check valve assembly 50 is closed (FIGS. 2 and 5), tapered surface 60 of valve body 54 presses against valve seat 52 to provide a seal, and when check valve assembly 50 is open (FIG. 6), fuel flows through fuel passage 43 via the clearance between bore 41 and valve body 54 and then through peripheral grooves 63 in star washer 58 which provide continuously open ports 64 to outlet 46.

The pre-load force produced by spring 56 and its spring rate are determined and selected so that check valve assembly 50 will open at a low pressure differential such as 2–5 psi which is well below the minimum fuel injector operating pressure (which is usually in the range of 20 to 40 psig). A valve stem 66 protrudes from valve body 54 axially within housing bore 41 and passes slidably through a central opening 68 in star washer 58 to axially align and guide axial movement of the valve body within housing bore 41. Preferably, valve stem 66 is brass and valve body 54 is a molded flourosilicone resin or other synthetic resin; both highly resistant to deterioration by gasoline, alcohol, diesel fuels and their usual contaminants.

Figure 5:
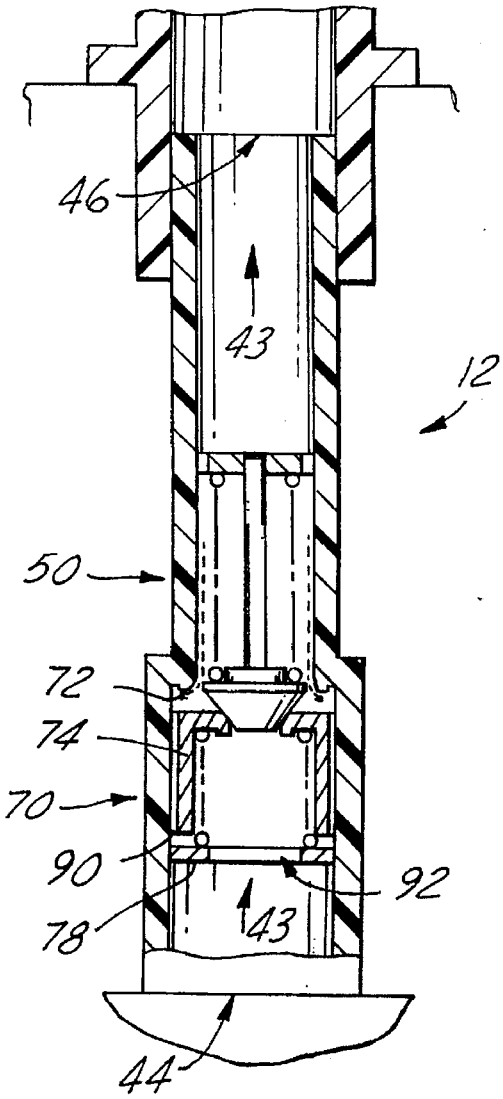
FIG. 5 is a fragmentary full sectional view of the valve assembly of FIG. 2 shown with the vent valve in its open position.

Valve assembly 12 also includes a normally closed vent valve assembly 70 disposed in fuel passage 43 upstream of check valve assembly 50. Valve assembly 70 has a fixed valve seat 72, preferably molded as an annular rib-integral with shoulder 42 of housing 40, a valve body 74, also molded of a synthetic resin, slidably received in housing counterbore 41*a* and yieldably biased to its closed position by a compression coil spring 76 retained by a washer 78 press fit into counterbore 41*a* near inlet 44 of housing 40. Valve body 74 is preferably a hollow cylindrical cup-like body with an outside diameter providing a close sliding fit within counterbore 41*a* defining inlet 44. The upstream end 80 of valve body 74 is open, and the downstream end 82 is capped off by an end closure wall 83 integrally molded with the valve body and having a flat exterior surface 84 adapted to sealably seat against rib valve seat 72. Wall 83 has an annular reinforcing rib 85 which defines a tapered bore 86, centrally located in wall 84. Bore 86 provides the mating surface defining valve seat 52 for sealably engaging surface 60 of check valve body 54. Longitudinal grooves 87 are provided on the outer surface 88 of valve body 74 which extend the entire length thereof and define fuel bleed ports 90 between the housing counterbore 41*a* and valve body 74 which allow fuel to bleed back around the check valve when the vent valve assembly is open (FIG. 5). When check valve assembly 50 is open (FIG. 6), fuel passes within the fuel passage 43 from inlet 44 through a fuel delivery port 92 centrally located in washer 78, through tapered bore 86 and around check valve body 54 to outlet 46.

Figure 6:
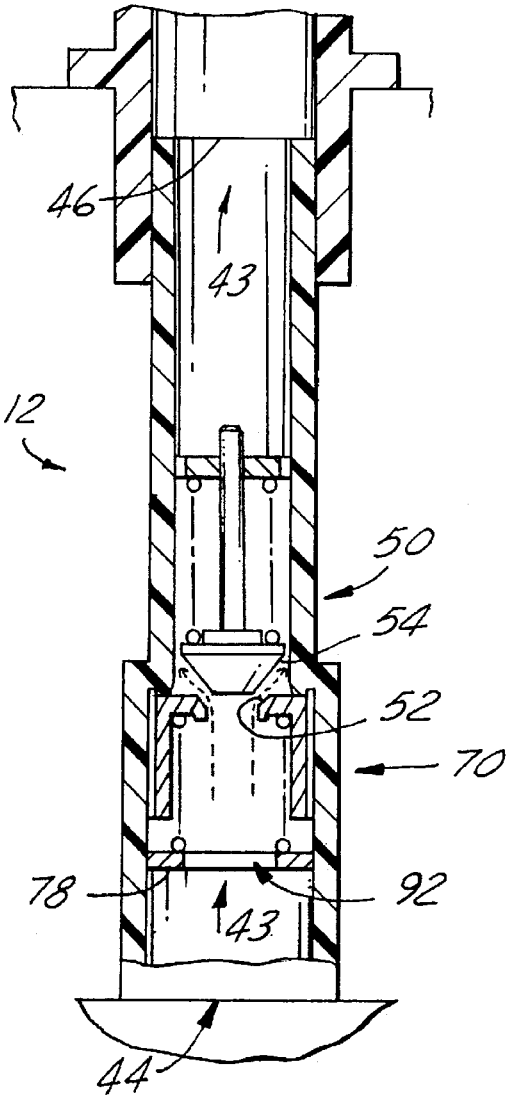
FIG. 6 is a fragmentary full sectional view of the valve assembly of FIG. 2 shown with the check valve in its open position.

Vent valve seat 72 is formed integral with housing shoulder 42 as an annular rib within fuel passage 43. Valve seat 72 abuts surface 84 radially inwardly of grooves 87 to thereby completely close off bleed ports 90 when vent valve assembly 70 is in the closed position with valve body 74 in abutment with valve seat 72, as shown in FIGS. 2 and 6. Spring 76 abuts at its upstream end against washer 78 and at its downstream end against the inside face of wall 83 thereby normally biasing valve body 74 against valve seat 72. The pre-load force produced by spring 76 and its spring rate are determined and selected such that the vent valve assembly 70 is normally closed and will open at a predetermined pressure differential, which is about equal to the desired minimum engine idle fuel pressure, usually about 25 psig. This is to maintain a minimum idle fuel pressure at the injectors and yet avoid an overly rich fuel to air mixture for the next engine start-up or increased throttle condition and to avoid a momentary overly rich fuel to air mixture when engine fuel demand rapidly goes from full throttle to idle.

Figure 7:
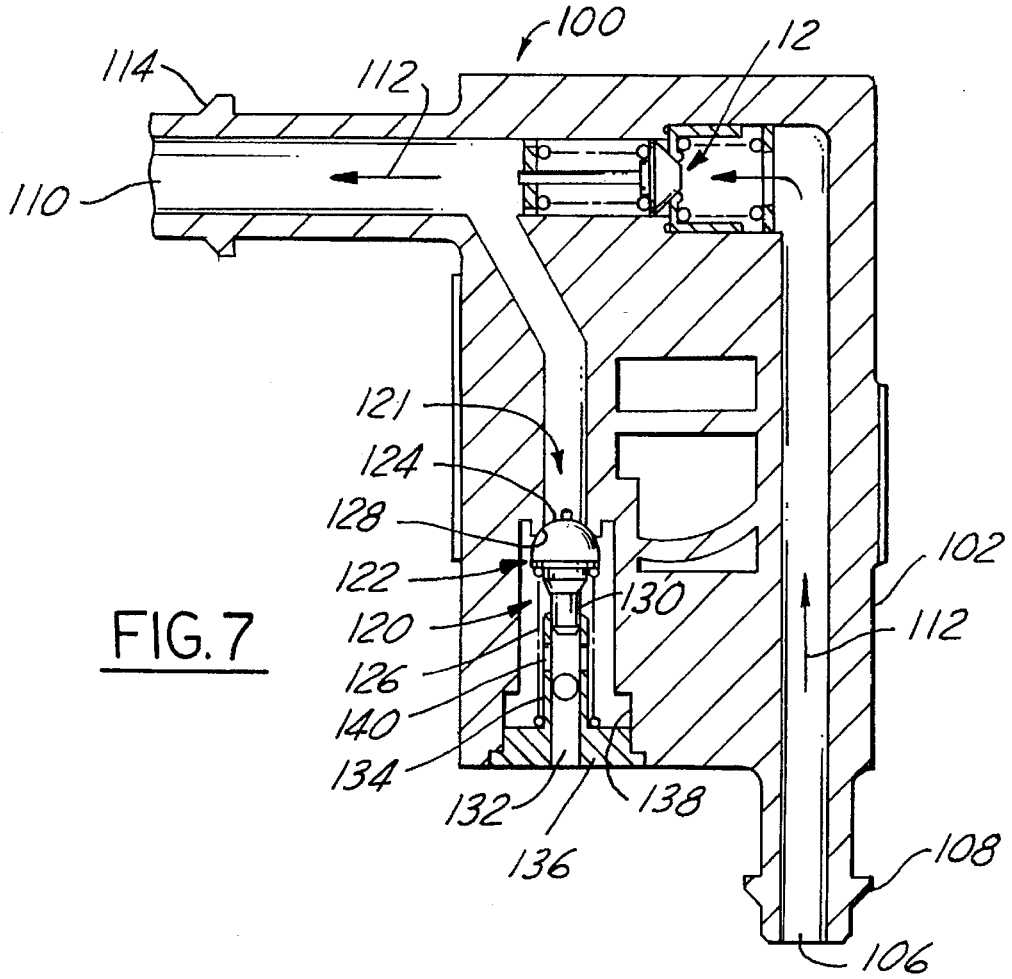
FIG. 7 is a fragmentary sectional view of a fuel pump manifold having the valve assembly of FIG. 2 shown with the check valve and the vent valve in their respective closed positions.
Figure 8:
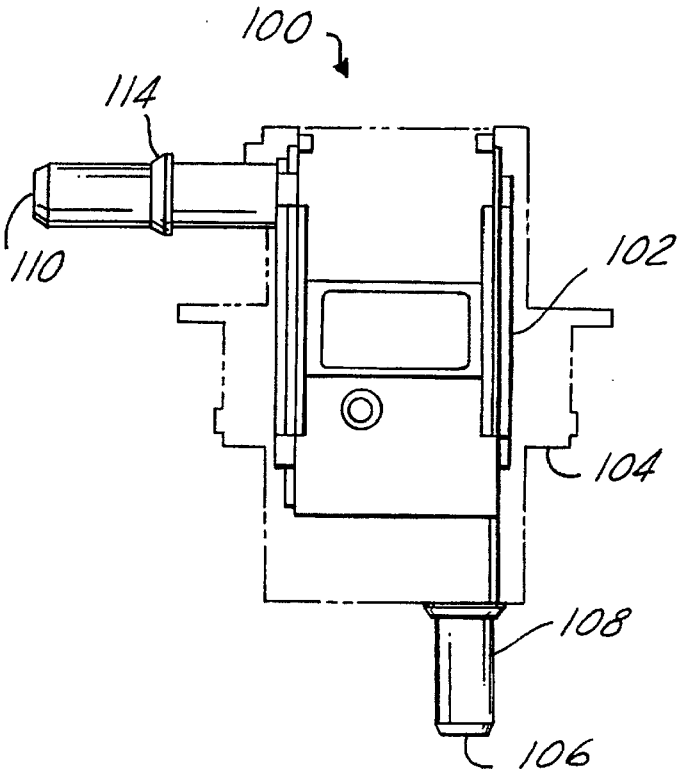
FIG. 8 is a side view of the manifold of FIG. 7 encapsulated in a cover of a fuel pump module.

In another embodiment, FIGS. 7 and 8 illustrate a fuel pump manifold 100 having a housing 102 preferably molded of a synthetic resin. Electronic circuitry therein (not shown) varies and controls the speed of electric drive motor 34 and hence the output of the fuel pump 30 shown in FIG. 1. Preferably, the manifold is encased by injection molding around it, a cover or top cap 104 of the fuel pump module, also of a synthetic resin.

As shown in FIG. 7, housing 102 has a fuel inlet 106 and a connector 108 which in assembly is connected to the outlet of the fuel pump. The manifold also has a fuel outlet 110 communicating with inlet 106 through a fuel passage 112 and an outlet connector 114 which in assembly is connected to the fuel delivery line 14. Within the fuel passage 112 there is a check and vent valve assembly 12 as previously disclosed except that housing 102 replaces housing 40 of the previously disclosed embodiment.

In addition to dual valve assembly 12 to protect the fuel system from over pressure, an additional normally closed relief valve assembly 120 is disposed within housing 102 in a passage 121 which communicates with the passage 112 downstream of valve assembly 12 and with the fuel pump module 10 and thence the fuel tank 26 by opening to the exterior of the housing 102. The relief valve assembly 120 has a valve body 122 with a hemispherical valve head 124 yieldably biased by a compression spring 126 into sealing engagement with a complementary seat 128 which is preferably spherical and molded in the housing 102. To guide and axially align the valve head with the seat, the body has a stem 130 slidably received in a bore 132 through a shank 134 of a retainer cap 136 press fit into a counterbore 138 in the housing. To permit fuel to be discharged through the bore 132, it communicates through ports 140 with the counterbore 138 in the housing. Preferably, to stabilize the spring and limit the extent to which the spring can laterally deflect from its axis as the valve opens and closes, the shank 134 projects into the spring and has an outside diameter which is only slightly smaller than the inside diameter of the spring. The extent to which the valve can be opened is limited by the valve body abutting the free end of the shank. Preferably, the stem 130 of the valve body is brass and its hemispherical head 124 is a molded flourosilicone resin or other synthetic resin highly resistant to attack and deterioration by gasoline, alcohol and diesel fuels and the contaminants normally found therein.

The relief valve preload force is determined and selected so that relief valve 120 is normally closed and will open at a predetermined pressure which is usually about 10 to 15 psi greater than the maximum normal operating pressure of the fuel system which is usually 40 to 60 psig. The relief valve protects the fuel system in the event there is a malfunction which causes the pump to continuously operate at maximum pressure or during periods of so-called "hot soaking" (with the engine running) where the pressure of the fuel increases above the desired maximum operating pressure due to an excessively high temperature of the fuel. In some vehicles, if there is a malfunction in the fuel system, the engine control module is programmed to cause the fuel pump to operate at maximum pressure so that the vehicle can "limp" home or be operated and driven to a service station for repair of the malfunction.

In use, the speed of electric motor 34 driving fuel pump 30 and hence the pressure of fuel supplied through valve assembly 12 to the engine is suitably controlled in a conventional manner in response to the load on the engine and other engine operating conditions. Under certain engine operating conditions, such as rapidly going from full throttle to idle, the fuel pressure supplied to the engine is momentarily greater than desired. Similar conditions occur in a vehicle with a manual transmission, as during each shift there are rapid throttle modulations changing engine conditions from load to idle and idle to load.

When engine load does change from full throttle to idle, the fuel pump motor continues to run at full speed until receiving the signal from the engine control unit and until it can decelerate to a shut down condition. This time lag coupled with the reduced engine fuel demand causes fuel pressure to build up at the injectors. To avoid an overly rich condition at the injectors, vent valve 70 opens allowing fuel to bypass check valve 50 and flow back through the pump. This occurs until the pressure differential across the dual valve assembly is about 25 psi or the minimum fuel pressure necessary for idle. Also, by bleeding fuel back through the fuel pump, parasitic loss of fuel is avoided.

As engine load increases again from idle, the fuel pump responds by increasing the pump motor speed which hence increases fuel pressure. Vent valve 70 closes when the pressure differential across the dual valve decreases to less than 25 psi. Check valve 50 opens allowing fuel to flow to the engine when the pump outlet pressure exceeds the fuel pressure down stream of the dual valve.

Under other engine conditions, the fuel system may be subjected to what is termed a "hot soak" condition. When the engine and fuel pump are shut off or operating at idle, engine compartment temperatures may rise due to hot weather conditions or hot engine components, thereby causing thermal expansion of the fuel downstream of check valve 50. Under such conditions, the vent valve 70 will again open as previously described to prevent an engine hot soak over pressure condition. The predetermined minimum pressure is preferably about equal to the fuel pressure required at engine idle conditions. This minimum fuel pressure will be maintained downstream of the check valve assembly to prevent fuel delivery delays for the next successive engine start-up or increased throttle condition needed for engine acceleration.

This invention may be practiced in a variety of embodiments, such as the check valve and/or relief valve bodies may be molded semihemispherical bodies and the valve seat mating surfaces molded to correspond. The check valve spring stop may be molded integral with the housing. The fuel delivery bore and bleed ports may take on a number of configurations and yet remain within the scope of the invention. The moveable valve seat may be the vent valve seat and the fixed valve seat the check valve seat without departing from the scope of the invention.

What is claimed is:

1. For a no-return fuel system for an engine with at least one fuel injector and a fuel pump with an inlet constructed for communicating with a reservoir of liquid fuel and an outlet providing fuel at an increased pressure, a valve assembly comprising, a housing, a fuel passage through said housing having an inlet constructed to communicate with the outlet of the fuel pump and an outlet for supplying liquid fuel to the engine fuel injector, a check valve in said fuel passage constructed and arranged to be normally closed when the fuel pump is not operating, and to open when the fuel pressure at said housing inlet exceeds the fuel pressure at said housing outlet, and a vent valve in said fuel passage communicating with said housing outlet and housing inlet, said vent valve having a vent valve seat fixed in said housing and a vent valve body in said fuel passage and movable relative to said housing and said vent valve seat to open and close said vent valve, and constructed and arranged to be normally closed and to open when the pressure of fuel at the housing outlet is greater than both a predetermined minimum pressure and the fuel pressure at the fuel pump outlet to bleed fuel through the passage in the housing and through the fuel pump outlet to reduce the pressure of the fuel at the housing outlet to such predetermined minimum pressure, and said check valve having a check valve seat on and movable in unison with said vent valve body and a check valve body movable relative to said housing and said vent valve body and yield yieldably biased by a preload onto said check valve seat to close said check valve.

2. The valve assembly according to claim 1 wherein said vent valve comprises a vent valve seat and a vent valve body yieldably biased against said vent valve seat with a first preload providing a predetermined minimum pressure which is substantially equal to the desired minimum housing outlet fuel pressure under engine idle conditions.

3. The valve assembly according to claim 2 wherein said predetermined minimum housing outlet pressure is at least about 25 psi.

4. The valve assembly according to claim 2 wherein said vent valve also comprises a spring providing such first preload.

5. The valve assembly according to claim 4 wherein said spring is retained at one end against said vent valve body and at its other end by a retainer fixedly received within said inlet of said fuel passage and constructed and arranged to abut said other end of said spring and still allow fuel to freely flow through said retainer.

6. For a no-return fuel system for an engine with at least one fuel injector and a fuel pump with an inlet constructed for communication with a reservoir of liquid fuel and an outlet providing fuel at an increased pressure, a valve assembly comprising, a housing, a fuel passage through said housing having an inlet constructed to communicate with the outlet of the fuel pump and an outlet for supplying liquid fuel to the engine fuel injector, a check valve in said fuel passage constructed and arranged to be normally closed when the fuel pump is not operating, and to open when the fuel pressure at said housing inlet exceeds the fuel pressure at said housing outlet, a vent valve in said fuel passage downstream of said check valve constructed and arranged to be normally closed and to open when the pressure of fuel at the housing outlet is greater than both a predetermined minimum pressure and the fuel pressure at the fuel pump outlet to bleed fuel through the passage in the housing and to the fuel pump to reduce the pressure of the fuel at the housing outlet to such predetermined minimum pressure, said vent valve has a vent valve seat and a vent valve body yieldably biased against said vent valve seat with a first preload providing a predetermined minimum pressure which is substantially equal to the desired minimum housing outlet fuel pressure under engine idle conditions, and said vent valve, when open, provides at least one fuel bleed port between said vent valve body and the inner wall of said fuel passage in said housing, said bleed port allowing fuel to bleed by said check valve, and when closed, prevents fuel from passing or returning through said fuel bleed port.

7. The valve assembly according to claim 6 wherein said vent valve body provides two or more of said fuel bleed ports.

8. The valve assembly according to claim 6 wherein said fuel bleed port is a longitudinal groove in the outer surface of and extending the entire length of said vent valve body.

9. The valve assembly according to claim 6 wherein said vent valve seat is integral with said housing and is formed as an annular ledge within said fuel passage of said housing constructed and arranged to abut said vent valve body radially inwardly of said fuel bleed port.

10. The valve assembly according to claim 6 wherein said check valve comprises a check valve seat, a check valve stem, and a check valve body yieldably biased against said check valve seat by a second preload, which allows said check valve to open when the fuel pressure at said housing inlet exceeds the fuel pressure at said housing outlet.

11. The valve assembly according to claim 10 wherein said vent valve body acts as said check valve seat such that said check valve, when open, allows fuel to pass from said housing inlet to said housing outlet through a bore in said vent valve body and when closed, seats against said check valve seat preventing fuel from returning back through said bore.

12. The valve assembly according to claim 10 wherein said second preload provides a predetermined minimum check valve pressure of about 2 psi.

13. The valve assembly according to claim 10 wherein said check valve also comprises a spring providing said second preload.

14. The valve assembly according to claim 10 wherein said check valve also comprises a spring stop fixedly received within said outlet of said fuel passage constructed and arranged to retain one end of said check valve spring and to receive and radially retain said check valve stem without preventing linear travel of said check valve stem or blocking fuel flow within said valve assembly.

15. For a no-return system for an engine with at least one fuel injector and an electric fuel pump, a valve assembly comprising, a housing, a fuel passage through said housing having an inlet constructed to communicate with the outlet of the fuel pump and an outlet for supplying liquid fuel to the engine fuel injector, a check valve in said fuel passage constructed and arranged to be normally closed when the fuel pump is not operating, and to open when the fuel pressure at said housing inlet exceeds the fuel pressure at said housing outlet, said check valve comprising a check valve seat, a check valve stem, a check valve spring, and a check valve body yieldably biased against said check valve seat by said check valve spring, and a vent valve within said fuel passage upstream of said check valve and constructed and arranged to be normally closed and to open when the pressure of fuel at said housing outlet is greater than both a predetermined minimum pressure and the pressure at the fuel pump outlet to bleed fuel through said fuel passage and to the fuel pump to reduce the pressure of fuel at said housing outlet to such predetermined minimum pressure, said vent valve comprising a vent valve seat, a vent valve spring and a vent valve body yieldably biased against said vent valve seat by said vent valve spring and wherein said vent valve body acts as said check valve seat such that said check valve, when open, allows fuel to pass from said inlet to said outlet through a bore in said vent valve body and when closed, seats against said check valve seat preventing fuel from returning back through said bore.

16. The valve according to claim 15 wherein said vent valve, when open, provides at least one fuel bleed port between said vent valve body and the inner wall of said fuel passage in said housing, said bleed port allowing fuel to bleed by said check valve, and when closed, prevents fuel from passing or returning through said fuel bleed port.

17. The valve according to claim 16 wherein said fuel bleed port is a longitudinal groove in the outer surface of and extending the entire length of said vent valve body.

18. For a no-return fuel system for an engine with at least one fuel injector and an electric fuel pump, a fuel manifold comprising, a housing, a fuel passage through said housing having an inlet constructed to communicate with the outlet of the fuel pump and an outlet for supplying liquid fuel to the engine fuel injector, a check valve in said fuel passage constructed and arranged to be normally closed when the fuel pump is not operating, and to open when the fuel pressure at said housing inlet exceeds the fuel pressure at said housing outlet, said check valve comprising a check valve seat, a check valve stem, a check valve spring, and a check valve body yieldably biased against said check valve seat by said check valve spring, and a vent valve within said fuel passage and constructed and arranged to be normally closed and to open when the pressure of fuel at said housing outlet is greater than both a predetermined minimum pressure and the pressure at the fuel pump outlet to bleed fuel through said fuel passage and to the fuel pump to reduce the pressure of fuel at said housing outlet to such predetermined minimum pressure, said vent valve comprising a vent valve seat fixed relative to said housing, a vent valve spring and a vent valve body in said fuel passage, carrying said check valve seat, movable relative to said housing and said vent valve seat, and yieldably biased against said vent valve seat by said vent valve spring.

19. The manifold of claim 18 which also comprises a relief passage in said housing and communicating with the exterior thereof and with said fuel passage downstream of said check valve, and a pressure relief valve disposed in said relief passage and constructed and arranged to be normally closed and to open when the pressure of fuel in said fuel passage downstream of said check valve exceeds a predetermined value which is greater than the normal maximum operating pressure of fuel in said fuel passage downstream of said check valve.

20. The manifold of claim 19 wherein said pressure relief valve includes a spring yieldably biasing said relief valve to its normally closed position with a preload force and constructed and arranged to open when the pressure of fuel in said fuel passage downstream of said check valve exceeds the normal maximum operating pressure of fuel in said fuel passage by 5 to 15 psi.

* * * * *